US010539160B2

(12) United States Patent
Nejedly et al.

(10) Patent No.: US 10,539,160 B2
(45) Date of Patent: Jan. 21, 2020

(54) DAMPING SYSTEM FOR AN E-CHARGER

(71) Applicant: HONEYWELL INTERNATIONAL INC., Morris Plains, NJ (US)

(72) Inventors: Milan Nejedly, Brno (CZ); Vit Houst, Sestajovice (CZ); Zbynek Oslejsek, Brno (CZ); Michal Mokos, Ivancice (CZ); Daniel Turecek, Ostopovice (CZ)

(73) Assignee: GARRETT TRANSPORTATION I INC, Torrance, CA (US)

( * ) Notice: Subject to any disclaimer, the term of this patent is extended or adjusted under 35 U.S.C. 154(b) by 153 days.

(21) Appl. No.: 15/491,029

(22) Filed: Apr. 19, 2017

(65) Prior Publication Data

US 2018/0306209 A1 Oct. 25, 2018

(51) Int. Cl.
*F04D 29/66* (2006.01)
*F04D 25/06* (2006.01)
(Continued)

(52) U.S. Cl.
CPC ..... *F04D 29/668* (2013.01); *F02B 33/34* (2013.01); *F02B 39/10* (2013.01); *F04D 25/06* (2013.01);
(Continued)

(58) Field of Classification Search
CPC .... F04D 29/668; F04D 25/06; F04D 25/0606; F04D 29/053; F04D 29/30; F04D 29/4206; F04D 29/624; F02B 39/10; F16C 35/067; F16C 33/58; F16C 33/581; F16C 35/077; F01D 25/164
(Continued)

(56) References Cited

U.S. PATENT DOCUMENTS 3,301,613 A * 1/1967 DeClaire ..... F01D 25/164 384/220
6,196,809 B1 * 3/2001 Takahashi ..... F04D 25/16 415/209.2
(Continued)

FOREIGN PATENT DOCUMENTS

EP 2639425 A1 9/2013
EP 2733359 A1 5/2014
(Continued)

OTHER PUBLICATIONS

Partial EP Search Report for Application No. 18167399.7 dated Sep. 28, 2018.

*Primary Examiner* — Philip E Stimpert
(74) *Attorney, Agent, or Firm* — Lorenz & Kopf, LLP

(57) ABSTRACT

A compressor assembly includes a shaft and a compressor wheel that is supported on the shaft. The compressor assembly also includes an electric motor with a stator and a rotor. The electric motor is configured to rotate the shaft and the compressor wheel. The compressor assembly additionally includes a housing assembly configured to house the stator, the rotor, and at least part of the shaft. The housing assembly includes a first member and a second member. Moreover, the compressor assembly includes a dampener disposed between the first member and the second member of the housing assembly. The dampener is configured to elastically deform to provide dampening of a force transferred between the first member and the second member of the housing assembly.

13 Claims, 5 Drawing Sheets

(51) Int. Cl.

| | |
|---|---|
| ***F04D 29/30*** | (2006.01) |
| ***F04D 29/42*** | (2006.01) |
| ***F04D 29/053*** | (2006.01) |
| ***F04D 29/62*** | (2006.01) |
| ***F02B 39/10*** | (2006.01) |
| ***F02B 33/34*** | (2006.01) |

(52) U.S. Cl.
CPC ..... *F04D 25/0606* (2013.01); *F04D 29/053* (2013.01); *F04D 29/30* (2013.01); *F04D 29/4206* (2013.01); *F04D 29/624* (2013.01)

(58) Field of Classification Search
USPC ..... 384/531, 585
See application file for complete search history.

(56) References Cited

U.S. PATENT DOCUMENTS

| | | | | |
|---|---|---|---|---|
| 7,723,883 | B2 * | 5/2010 | Ozaki | F01D 15/005 310/90.5 |
| 2004/0037716 | A1 | 2/2004 | Jaisle | |
| 2004/0088976 | A1 * | 5/2004 | Jaisle | F01D 11/04 60/602 |
| 2014/0090626 | A1 | 4/2014 | An et al. | |
| 2015/0337850 | A1 | 11/2015 | An et al. | |
| 2017/0037858 | A1 | 2/2017 | Back et al. | |
| 2017/0145909 | A1 * | 5/2017 | Huh | F02B 37/18 |

FOREIGN PATENT DOCUMENTS

| | | | |
|---|---|---|---|
| EP | 2924261 | A1 | 9/2015 |
| EP | 3144497 | A1 | 3/2017 |
| JP | 2005240978 | A | 9/2005 |
| JP | 2005248856 | A | 9/2005 |

* cited by examiner

DAMPING SYSTEM FOR AN E-CHARGER

TECHNICAL FIELD

The present disclosure generally relates to an electrically driven compressor assembly such as an e-charger, and more particularly relates to a damping system for an e-charger.

BACKGROUND

Some vehicles include a turbocharger, supercharger and/or other devices for boosting the performance of an internal combustion engine. More specifically, these devices can increase the engine's efficiency and power output by forcing extra air into the combustion chamber of the engine.

In some cases, the vehicle may include an electrically driven compressor, or e-charger, for these purposes. However, conventional e-chargers can be bulky, cost prohibitive, and/or may present other issues.

Thus, it is desirable to provide an e-charger that is more compact than conventional e-chargers. Also, it is desirable to provide an e-charger that provides cost savings compared to conventional e-chargers. Other desirable features and characteristics of the present disclosure will become apparent from the subsequent detailed description and the appended claims, taken in conjunction with the accompanying drawings and this background discussion.

BRIEF SUMMARY

In one embodiment, an electrically driven compressor assembly is disclosed that includes a shaft and a compressor wheel that is supported on the shaft. The compressor assembly also includes an electric motor with a stator and a rotor. The electric motor is configured to rotate the shaft and the compressor wheel. The compressor assembly additionally includes a housing assembly configured to house the stator, the rotor, and at least part of the shaft. The housing assembly includes a first member and a second member. Moreover, the compressor assembly includes a dampener disposed between the first member and the second member of the housing assembly. The dampener is configured to elastically deform to provide dampening of a force transferred between the first member and the second member of the housing assembly.

In another embodiment, a method of manufacturing an electrically driven compressor assembly is disclosed. The method includes providing a first member and a second member of a housing assembly. The method also includes supporting a shaft on the first member for rotation relative to the first member. A compressor wheel is supported on the shaft. The method further includes housing an electric motor within the housing assembly between the first member and the second member. The electric motor is configured to rotate the shaft and the compressor wheel. Moreover, the method includes attaching the first member and the second member together with a dampener between the first member and the second member. The dampener is configured to elastically deform to provide dampening of a force transferred between the first member and the second member of the housing assembly.

In an additional embodiment, an e-charger is disclosed that includes a shaft and a compressor wheel with a plurality of blades. The compressor wheel is fixed for rotation on the shaft for rotation about an axis. The e-charger also includes an electric motor with a stator and a rotor. The rotor is fixed to the shaft. The stator receives the rotor and a portion of the shaft. The electric motor is configured to rotate the shaft and the compressor wheel about the axis. Additionally, the e-charger includes a housing assembly with a compressor section and a motor section. The compressor section is configured to house the compressor wheel, and the motor section is configured to house the stator and the rotor. The motor section includes a first member and a second member. The shaft extends through the second member to be received in the compressor section and the motor section. Also, the e-charger includes a bearing that is attached to the second member of the housing assembly and that is attached to the shaft. The bearing supports the shaft for rotation relative to the second member about the axis. Furthermore, the e-charger includes a dampener disposed between the first member and the second member of the housing assembly. The dampener is configured to elastically deform to provide dampening of a force transferred between the first member and the second member of the housing assembly.

BRIEF DESCRIPTION OF THE DRAWINGS

The present disclosure will hereinafter be described in conjunction with the following drawing figures, wherein like numerals denote like elements, and wherein.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Broadly, example embodiments disclosed herein include a damping system of an electrically powered compressor (i.e., an e-charger). One or more dampeners may be provided for damping forces translating through the e-charger and/or supporting structure(s).

In particular, the dampener may be resiliently deformable. The dampener may also include one or more surface features, shapes, dimensions, materials, and/or other elements that provide improved dampening. Additionally, the dampener may be incorporated within the damping system in ways that improve its damping function. For example, the dampener may be disposed between different members of a housing assembly, and the dampener may be supported by these members to provide effective damping of the forces transferring through the housing assembly. Furthermore, the damping system may allow certain types of bearings to be incorporated in the e-charger for added benefit. Moreover, the damping system may provide manufacturing efficiencies due to one or more features of the present disclosure. Additional details of the present disclosure will be discussed below.

Figure 1:
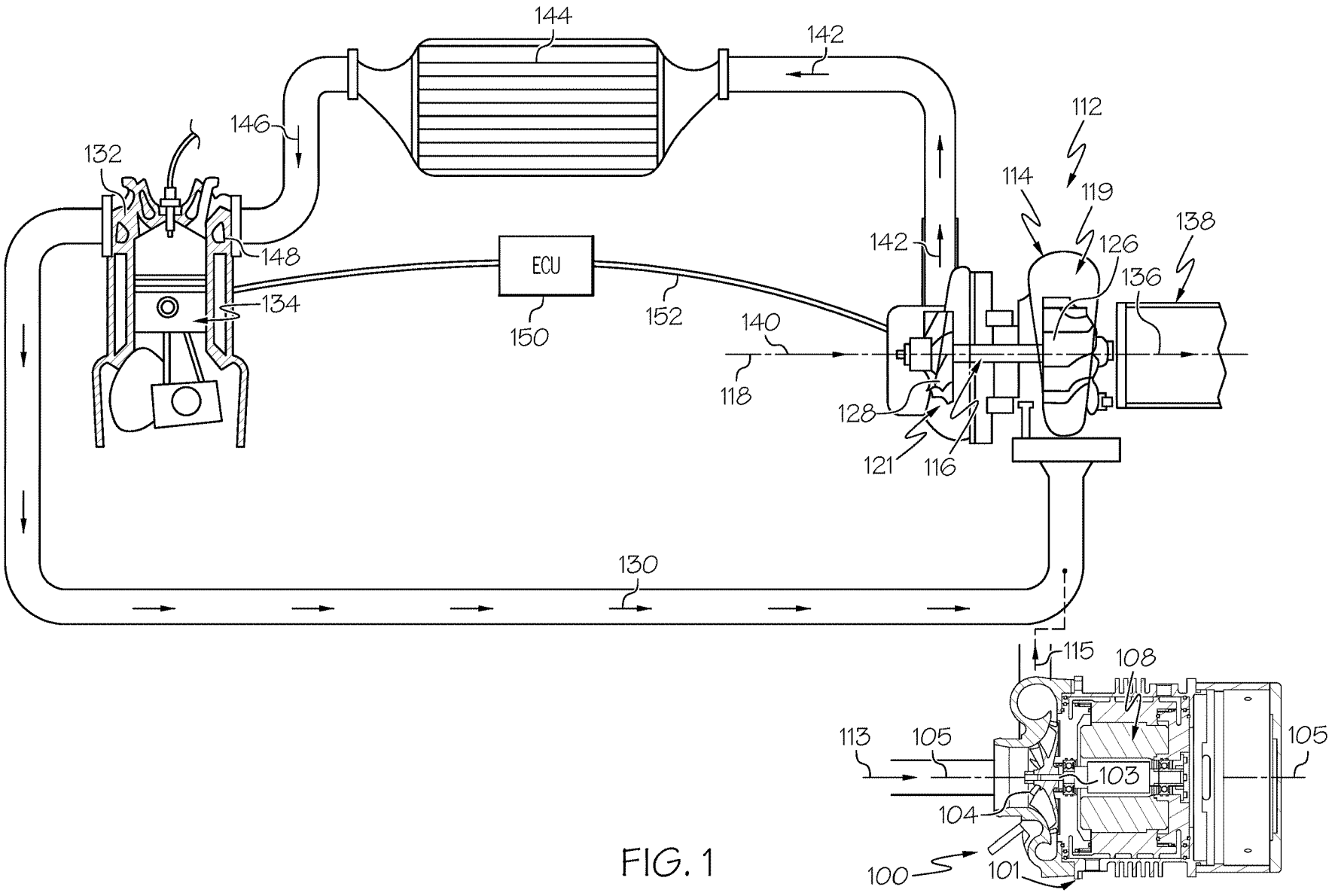
FIG. 1 is a schematic view of a vehicle engine system, which includes an e-charger according to example embodiments of the present disclosure.

FIG. 1 is a schematic view of an example e-charger 100 of the present disclosure. Generally, the e-charger 100 may include an e-charger housing assembly 101 and a shaft 103. The shaft 103 is configured to rotate within the e-charger housing assembly 101 about an axis 105 of rotation. A compressor wheel 104 may be mounted on the shaft 103. The e-charger 100 may also include an electric motor 108 that is configured to rotate the shaft 103 and compressor wheel 104. Accordingly, the compressor wheel 104 may receive an inlet air flow 113 and output a pressurized air stream 115 to a downstream component.

In some embodiments, the e-charger 100 may be provided within a vehicle. Additionally, in some embodiments, the e-charger 100 may be incorporated in a vehicle that includes a turbocharger 112.

The turbocharger 112 may be conventional and may include a turbocharger housing 114 and a rotor 116. The rotor 116 is configured to rotate within the turbocharger housing 114 about an axis of rotor rotation 118.

The turbocharger 112 includes a turbine section 119 configured to circumferentially receive a high-pressure and high-temperature exhaust gas stream 130 from an engine (e.g., from an exhaust manifold 132 of an internal combustion engine 134 or other type of engine). A turbine wheel 126 (and thus the rotor 116) is driven in rotation around the axis of rotor rotation 118 by the high-pressure and high-temperature exhaust gas stream 130, which becomes a lower-pressure and lower-temperature exhaust gas stream 136 that is released into a downstream exhaust pipe 138.

The turbocharger 112 also includes a compressor section 121 with a compressor wheel 128 that is driven in rotation by the exhaust-gas driven turbine wheel 126. The compressor wheel 128 is configured to compress received input air 140 into a pressurized air stream 142. Due to the compression process, the pressurized air stream 142 is characterized by an increased temperature, over that of the input air 140.

The air stream 142 may be channeled through an air cooler 144 (i.e., an intercooler), such as a convectively cooled charge air cooler. The air cooler 144 may be configured to dissipate heat from the air stream 142, increasing its density. The resulting cooled and pressurized air stream 146 is channeled into an intake manifold 148 of the internal combustion engine 134, or alternatively, into a subsequent-stage, in-series compressor. The operation of the system may be controlled by an ECU 150 (engine control unit) that connects to the remainder of the system via communication connections 152.

As represented schematically in FIG. 1, the e-charger 100 may be disposed upstream of the turbocharger 112. For example, the air stream 115 output from the e-charger 100 may mix with the exhaust gas stream 130 and/or otherwise provide air input to the turbine section 119 to turn the turbine wheel 126 and, thus, rotate the compressor wheel 128 of the turbocharger 112. However, it will be appreciated that the e-charger 100 may be incorporated differently within the vehicle without departing from the scope of the present disclosure. For example, the e-charger 100 may be disposed downstream of the turbocharger 112 in some embodiments. In both cases, the e-charger 100 may feed air to the engine 134. The e-charger 100 may reduce transient time and turbo lag. The e-charger 100 may also provide benefits, such as reduced emissions, improved fuel efficiency, etc. Also, the size of the turbocharger 112 may be reduced due to the inclusion of the e-charger 100.

Also, it will be appreciated that the e-charger 100 may be incorporated in a system that does not include a turbocharger 112. For example, in additional embodiments, the e-charger 100 may be configured to feed air to a fuel cell of a vehicle.

In addition, it will be appreciated that the term "e-charger" as used herein is to be interpreted broadly, for example, to include devices with an electrically driven compressor wheel regardless of where the e-charger is incorporated, the type of system in which the e-charger is incorporated, etc. It will also be appreciated that the e-charger of the present disclosure may also be referred to as an electrically driven compressor assembly. Also, the e-charger of the present disclosure may be configured as an electric supercharger, as a hybrid turbocharger, as an e-boost device, or other related component.

Figure 2:
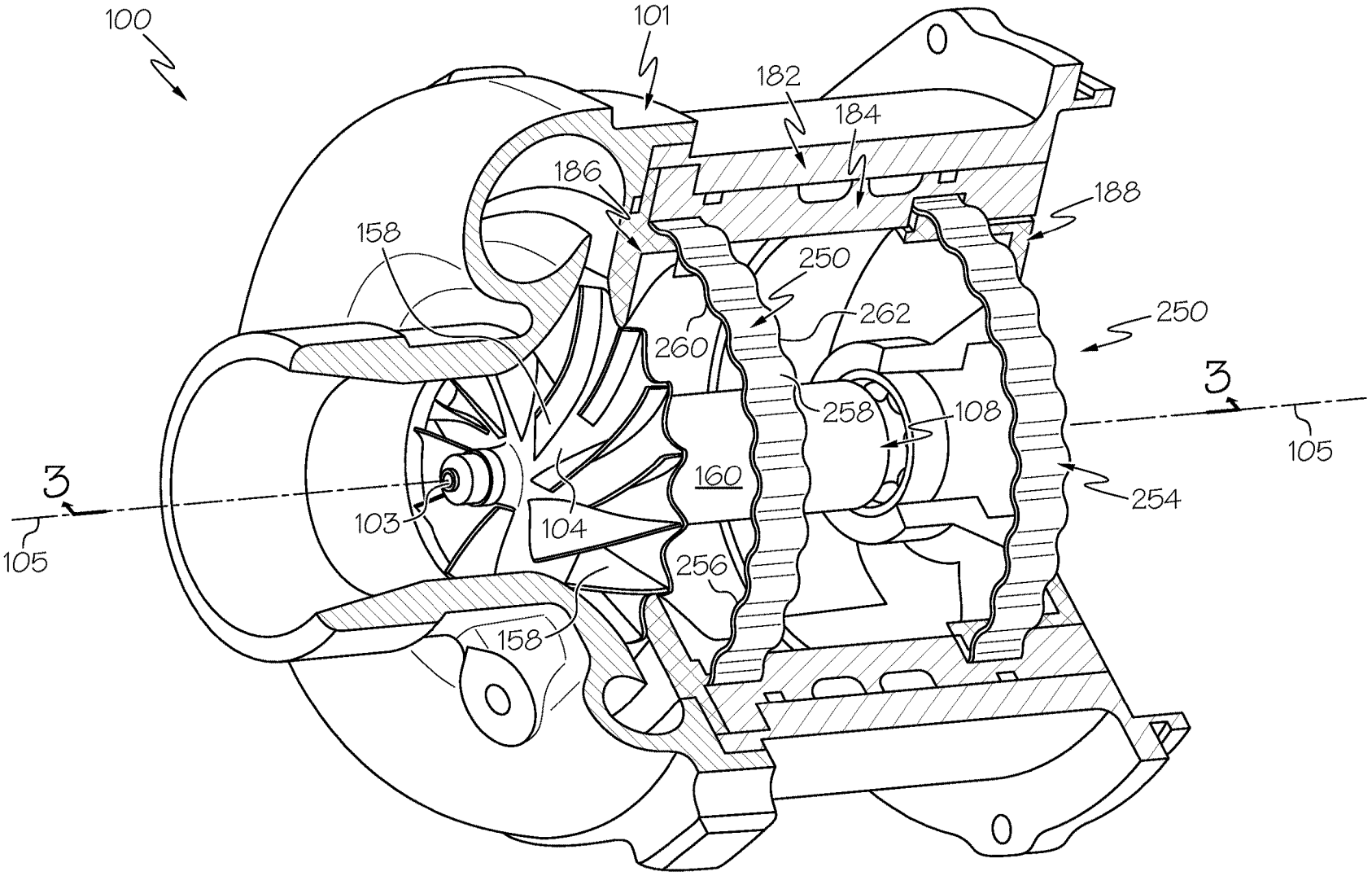
FIG. 2 is a perspective view of the e-charger of FIG. 1 with some features hidden to show internal components of the e-charger.
Figure 3:
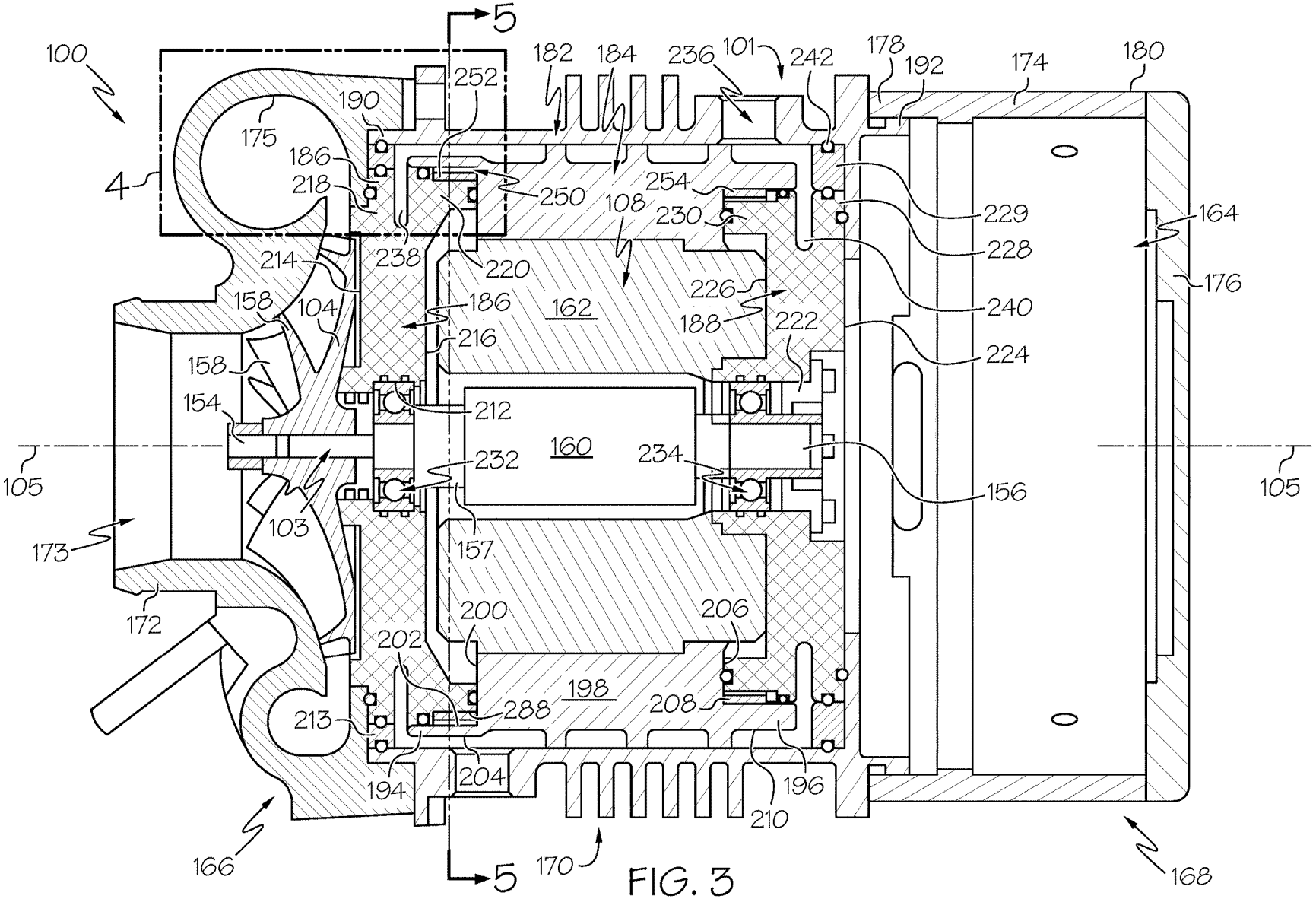
FIG. 3 is a cross sectional view of the e-charger taken along the line 3-3 of FIG. 2.

Referring now to FIGS. 2 and 3, the e-charger 100 will be discussed in greater detail according to example embodiments. As mentioned above, the e-charger 100 may generally include the housing assembly 101, the shaft 103, the compressor wheel 104, and the electric motor 108.

The shaft 103 may be substantially cylindrical and may include a first end 154, a second end 156, and an intermediate segment 157 extending between the first and second ends 154, 156. The compressor wheel 104 may be fixed to the shaft 103 and supported thereon adjacent the first end 154. The compressor wheel 104 may include a plurality of radially-extending blades 158.

The electric motor 108 may include a rotor 160. The rotor 160 may be fixed to the intermediate segment 157 of the shaft 103. Accordingly, the rotor 160 and the shaft 103 may rotate as a unit about the axis 105 of rotation. The electric motor 108 may also include a stator 162 as shown in FIG. 3. (The stator 162 is hidden in FIG. 2 to better illustrate other components.) The stator 162 may be cylindrical and hollow such that the intermediate segment 157 of the shaft 103 and the rotor 160 are received within the stator 162.

The electric motor 108 may further include an electric module 164. The electric module 164 may include electrical equipment, such as a converter, circuitry, a controller for the electric motor 108, and/or other components. Thus, during operation, the electric module 164 may control the electric motor 108 such that the shaft 103 and the rotor 160 rotate about the axis 105 of rotation relative to the stator 162 in order to drivingly rotate the compressor wheel 104.

The housing assembly 101 may include a number of components that are assembled together to at least partially house, surround, enclose, and/or encapsulate the compressor wheel 104, the shaft 103, and the electric motor 108. The housing assembly 101 may be configured to provide certain advantages with regards to manufacturability and/or other factors as will be discussed in detail below.

As shown in FIG. 3, the housing assembly 101 may generally include a compressor section 166, which houses the compressor wheel 104. The housing assembly 101 may also generally include an e-module section 168, which houses the electric module 164. Also, the housing assembly 101 may generally include a motor section 170, which houses the electric motor 108.

The compressor section 166 of the housing assembly 101 may include a volute member 172. The volute member 172 may include an inlet 173 that may be directed along the axis 105. The volute member 172 may also include an outlet (not shown) which provides air along the air stream 115 (FIG. 1). The volute member 172 may further include an interior surface 175 with a volute shape extending circumferentially about the axis 105. During operation of the e-charger 100, the interior surface 175 may cooperate with the blades 158 of the compressor wheel 104 to compress air along the air stream 115. The volute member 172 may be fixed on one end of the motor section 170 of the housing assembly 101. Accordingly, the volute member 172 and the end of the motor section 170 may cooperate to house the compressor wheel 104 and the first end 154 of the shaft 103.

As shown in FIG. 3, the e-module section 168 may be fixed on an opposite end of the motor section 170. The e-module section 168 may include a shell 174 and an end cap 176. The shell 174 may be cylindrical and hollow with a first end 178 and a second end 180. The first end 178 may be fixed to the motor section 170. The end cap 176 may be disc-shaped and may be fixed to the second end 180 of the shell 174 to close off the second end 180. Accordingly, the shell 174, the end cap 176, and the end of the motor section 170 may cooperate to substantially encapsulate the electric module 164.

The motor section 170 of the housing assembly 101 may include an outer shell member 182, a first member 184, a second member 186, and a third member 188. In some embodiments, the outer shell member 182 may cooperate with the volute member 172 and the e-module section 168 to define the exterior of the e-charger 100. Also, in some embodiments, the first member 184 may be referred to as a "stator housing" because it substantially surrounds the stator 162. Furthermore, the second member 186 and the third member 188 may be referred to as "bearing plates" or "end caps". In some embodiments, the first member 184, the second member 186, and the third member 188 may cooperate to substantially encapsulate the rotor 160 and the stator 162.

In some embodiments, the outer shell member 182 may be generally cylindrical and may be hollow so as to encircle the axis 105 in the circumferential direction. The outer shell member 182 may include a first end 190 and a second end 192. The first end 190 may be fixed to the volute member 172. For example, as shown in FIG. 3, the volute member 172 may radially overlap the outer diameter surface of the first end 190 of the outer shell member 182. The second end 192 of the outer shell member 182 may be fixed to the e-module section 168. For example, the shell 174 of the e-module section 168 may radially overlap the outer diameter surface of the second end 192 of the outer shell member 182.

The first member 184 of the housing assembly 101 may also be generally cylindrical and may be hollow. Accordingly, the first member 184 may encircle the axis 105 in the circumferential direction and may extend longitudinally along the axis 105. The first member 184 may include a first end 194, a second end 196, and an intermediate portion 198 that extends along the axis 105 between the first and second ends 194, 196.

Figure 4:
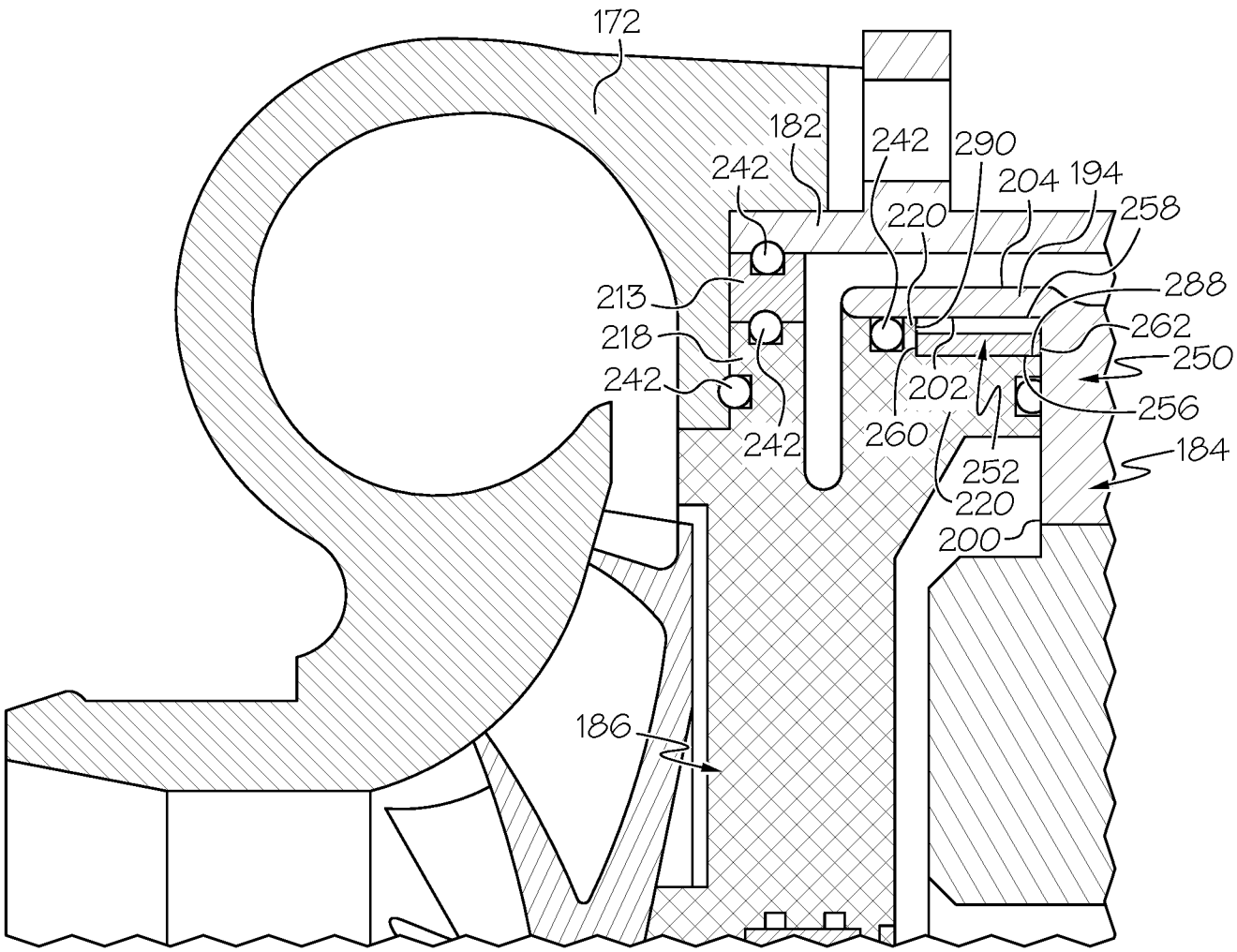
FIG. 4 is a detail section view of a portion of the e-charger indicated in FIG. 3.

As shown in FIGS. 3 and 4, the first end 194 of the first member 184 may be an annular flange that projects in a longitudinal direction along the axis 105 from a front vertical face 200 of the intermediate portion 198. The first end 194 may include an inner diameter surface 202, which faces radially inward, and an outer diameter surface 204, which faces radially outward.

As shown in FIG. 3, the second end 196 of the first member 184 may be an annular flange that projects from a rear vertical face 206 of the intermediate portion 198. The second end 196 may include an inner diameter surface 208, which faces radially inward, and an outer diameter surface 210, which faces radially outward.

The second member 186 of the housing assembly 101 may be generally disc-shaped. As shown in FIG. 3, the second member 186 may include a central opening 212 that is substantially centered on the axis 105. The second member 186 may also include an outer face 214 that faces the compressor wheel 128 and an inner face 216 that faces the electric motor 108. Moreover, as shown in FIGS. 3 and 4, the second member 186 may include a first outer portion 218 that is supported against the volute member 172 and the outer shell member 182. In some embodiments, the housing assembly 101 may also include a ring 213 that is disposed between the first outer portion 218 and the outer shell member 182. The second member 186 may further include a second outer portion 220 that is disposed adjacent the first end 194 of the first member 184 of the housing assembly 101 and the front vertical face 200 of the first member 184 of the housing assembly 101. In some embodiments, the second outer portion 220 may be radially overlapped and received within the open first end 194 of the first member 184 of the housing assembly 101. Accordingly, the second member 186 may allow passage of the first end 154 of the shaft 103 from the motor section 170 to the compressor section 166 of the housing assembly 101. The second member 186 may also support the shaft 103 for rotation within the housing assembly 101 as will be discussed in detail below. Moreover, the second member 186 may act as a barrier between the compressor wheel 104 and the electric motor 108.

The third member 188 of the housing assembly 101 may be generally disc-shaped. The third member 188 may include a central opening 222 that is substantially centered on the axis 105. The third member 188 may also include an outer face 224 that faces the electric module 164 and an inner face 226 that faces the electric motor 108. Moreover, the third member 188 may include a first outer portion 228 that is supported against the outer shell member 182. In some embodiments, the housing assembly may also include a ring 229 that is disposed between the first outer portion 228 and the outer shell member 182. Additionally, the third member 188 may include a second outer portion 230 that is disposed adjacent the second end 196 of the first member 184 of the housing assembly 101. In some embodiments, the second outer portion 230 may be radially overlapped and received within the open second end 196 of the first member 184 of the housing assembly 101. The third member 188 may also support the shaft 103 for rotation within the housing assembly 101 as will be discussed in detail below. Moreover, the third member 188 may act as a barrier between the electric motor 108 and the electric module 164.

As mentioned, the housing assembly 101 may support the shaft 103 and the rotor 160 for rotation about the axis 105. For example, as shown in FIG. 3, the e-charger 100 may include a first bearing 232 and a second bearing 234. The first bearing 232 may be disposed in the central opening 212 of the second member 186 and may include an outer race that is fixed to the second member 186, an inner race that is fixed to the intermediate segment 157 of the shaft 103, and a plurality of ball bearings disposed between the inner and outer races. The second bearing 234 may be similar, except it may be disposed in the central opening 222 of the third member 188, with its outer race fixed to the third member 188 and its inner race fixed to the intermediate segment 157 of the shaft 103.

In some embodiments, the first bearing 232 and/or the second bearing 234 may be greasepack ball bearings. These bearings may provide cost savings in some embodiments. Also, these types of bearings can be packaged within relatively compact spaces within the e-charger.

Furthermore, the e-charger 100 may include at least one coolant flowpath therethrough. For example, as shown in FIG. 3, the e-charger 100 may include a port 236, a front groove 238, and a rear groove 240. The port 236 may extend through the outer shell member 182 and allow coolant flow into or out of the e-charger 100. The front groove 238 may extend radially into the second member 186, separating the first and second outer portions 218, 220 of the second member 186. The rear groove 240 may extend radially into the third member 188, separating the first and second outer portions 228, 230. Accordingly, coolant may flow between the port 236, the front groove 238, and the rear groove 240 to provide a cooling effect for the e-charger 100.

Additionally, the e-charger 100 may include a number of seals, such as O-rings 242. The O-rings 242 may be conventional and may be provided between different members of the housing assembly 101 to prevent leakage of the coolant, to prevent intrusion of foreign materials, and/or to otherwise provide a seal between different members of the e-charger 100.

As shown in FIGS. 2, 3, and 4, the e-charger 100 may also include a damping system 250. The damping system 250 may include a first dampener 252 and a second dampener 254 in some embodiments. The first dampener 252 and the second dampener 254 may be substantially similar to each other except as noted below.

Figure 5:
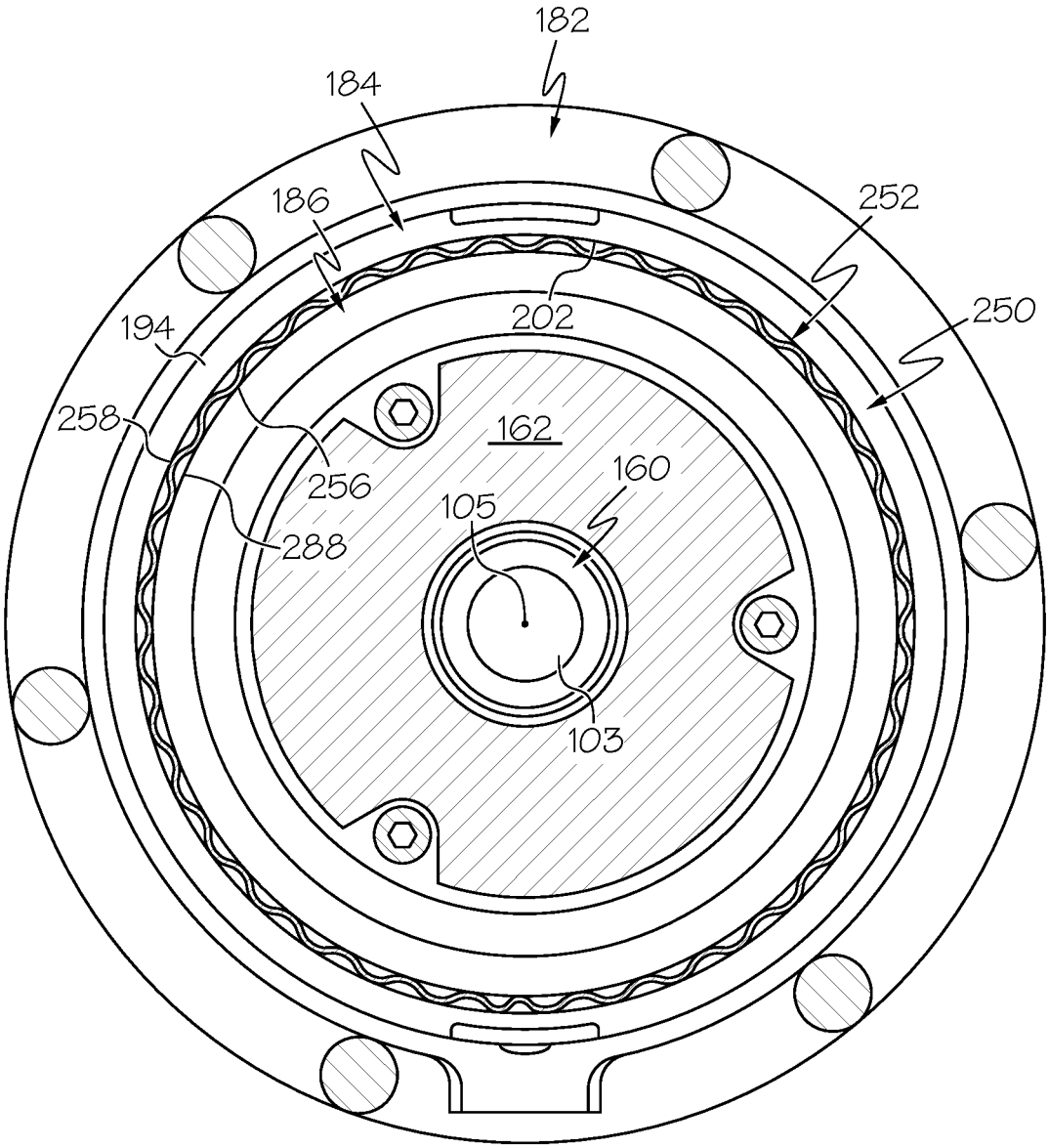
FIG. 5 is a cross sectional view of the turbocharger taken along the line 5-5 of FIG. 3.

The first dampener 252 may be substantially annular. As shown in FIG. 5, the first dampener 252 may be a unitary (i.e., one-piece) member that extends annularly and continuously about the axis 105 of rotation As shown in FIGS. 2 and 4, the first dampener 252 may include an inner radial surface 256 and an outer radial surface 258. The first dampener 252 may further include an outer edge 260 and an inner edge 262.

In some embodiments, the inner radial surface 256 and/or the outer radial surface 258 may be uneven. For example, the inner radial surface 256 and the outer radial surface 258 may be wavy, bumpy, and/or corrugated in some embodiments. As such, the inner radial surface 256 may have alternating peaks and troughs as shown in FIG. 2. The outer radial surface 258 may similarly include alternating peaks and troughs. The peaks and troughs of the inner radial surface 256 may be inverse to those of the peaks and troughs of the outer radial surface 258. Also, in some embodiments, a thickness of the dampener 252 (measured between the inner radial surface 256 and the outer radial surface 258) may be substantially constant and continuous in the circumferential direction about the axis 105.

The first dampener 252 may be made out of a metallic material in some embodiments. Also, the first dampener 252 may be resilient and flexible. As such, the dampener 252 may elastically deform (e.g., between a neutral first position shown in the Figures and a second deformed position). In some embodiments, the inner radial surface 256 and/or the outer radial surface 258 may deform when the first dampener 252 is subjected to sufficient force. For example, the waves, bumps, and/or corrugations may elastically deflect when the first dampener 252 is under a sufficient load.

The first dampener 252 may be disposed between the first member 184 and the second member 186 of the housing assembly 101. More specifically, as shown in FIG. 5, portions of the inner radial surface 256 of the first dampener 252 may abut against an opposing outer diameter surface 288 of the second outer portion 220 of the second member 186. Also, portions of the outer radial surface 258 may abut against the opposing inner diameter surface 202 of the first end 194 of the first member 184. Furthermore, as shown in FIG. 4, the outer edge 260 may abut against an opposing shoulder 290 of the second outer portion 220. Additionally, the inner edge 262 may abut against the opposing front vertical face 200 of the first member 184 of the housing assembly 101.

Accordingly, the first dampener 252 may provide dampening of forces (e.g., vibrational and other forces) that transfer between the first member 184 and the second member 186 of the housing assembly 101. The first dampener 252 may resiliently deflect in order to dampen and reduce these forces. Also, in some embodiments, the first dampener 252 may provide dampening to forces that are directed radially and/or axially with respect to the axis 105.

The second dampener 254 may be substantially similar to the first dampener 252 except that the second dampener 254 may be disposed between the first member 184 and the third member 188. Specifically, as shown in FIG. 3, the second dampener 254 may abut radially against the second outer portion 230 of the third member 188 and the second end 196 of the first member 184. Also, the second dampener 254 may abut axially against the first member 184 and the third member 188. Accordingly, the second dampener 254 may provide dampening to radial and/or axial forces that transfer between the first member 184 and the third member 188.

Accordingly, the damping system 250 of the present disclosure may reduce radial and axial loads of the e-charger 100. The damping system 250 may also increase the operating life of the e-charger, for example, because loading on the bearings 232, 234 may be reduced. Also, since the loads are reduced, the bearings 232, 234 included in the e-charger 100 may be relatively cost-effective and compact bearings, such as greasepack ball bearings. Furthermore, the dampeners 252, 254 may compensate for any bearing misalignment. Also, the dampeners 252, 254 may decrease vibration of the stator 162. The temperature of the damping system 250 may be controlled, for example, by the coolant flowing within the nearby coolant grooves 238, 240. In addition, the damping system 250 may allow the e-charger 100 to be more compact than conventional e-chargers. Moreover, the damping system 250 may provide increased manufacturing efficiency. For example, the dampeners 252, 254 may be relatively simple to assemble within the housing assembly 101. Thus, the e-charger 100 may be manufactured and assembled in an efficient manner.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment of the present disclosure. It is understood that various changes may be made in the function and arrangement of elements described in an exemplary embodiment without departing from the scope of the present disclosure as set forth in the appended claims.

What is claimed is:

1. An electrically driven compressor assembly comprising:

a shaft;

a compressor wheel that is supported on the shaft;

an electric motor with a stator and a rotor, the electric motor configured to rotate the shaft and the compressor wheel;

a housing assembly that houses the stator, the rotor, and at least part of the shaft, the housing assembly including a first member, a second member, and a third member that cooperate to encapsulate the rotor and the stator, the first member including an open end, the second member at least partly covering the open end and a first radial surface of the first member opposing a second radial surface of the second member;

a first bearing that is attached to the second member of the housing assembly and that is attached to the shaft, the first bearing supporting the shaft for rotation relative to the second member about an axis of rotation;

a second bearing that is attached to the third member and the shaft, the second bearing supporting the shaft for rotation relative to the third member about the axis of rotation;

a first dampener disposed between the first radial surface of the first member and the second radial surface of the second member of the housing assembly, a radial space defined between the first dampener and one of the first radial surface and the second radial surface, the first dampener configured to elastically deform to provide dampening of a radial force transferred between the first member and the second member of the housing assembly with respect to the axis of rotation; and a second dampener that is disposed between the first member and the third member, the second dampener configured to elastically deform to provide dampening of a force that is transferred between the first member and the third member of the housing assembly.

2. The compressor assembly of claim 1, wherein the first dampener is configured to elastically deform between a first position and a second position;

wherein the first dampener includes a first dampener surface that is uneven in the first position; and wherein the first dampener surface is configured to deform as the first dampener moves between the first position and second position.

3. The compressor assembly of claim 2, wherein the first dampener extends in a circumferential direction about the axis of rotation, wherein the first dampener includes an inner radial surface facing the axis of rotation and an outer radial surface facing away from the axis of rotation, and wherein the first dampener surface is one of the inner radial surface and the outer radial surface is uneven in the first position.

4. The compressor assembly of claim 3, the first dampener surface is the inner radial surface of the first wherein the outer radial surface of the first dampener is uneven in the first position, and wherein the outer radial surface of the first dampener is configured to deform as the first dampener moves between the first position and the second position.

5. The compressor assembly of claim 4, wherein the first dampener has a thickness measured between the inner radial surface of the first dampener and the outer radial surface of the first dampener; and wherein the thickness of the first dampener is constant along the circumferential direction.

6. The compressor assembly of claim 3, wherein the at least one of the inner radial surface of the first dampener and the outer radial surface of the first dampener includes a plurality of alternating peaks and troughs in the first position.

7. The compressor assembly of claim 1, wherein the first member of the housing assembly includes a first inner diameter surface;

wherein the second member of the housing assembly includes a second outer diameter surface that faces the first inner diameter surface;

wherein the dampener abuts the first inner diameter surface of the first member of the housing assembly; and wherein the dampener abuts the second outer diameter surface of the second member of the housing assembly.

8. The compressor assembly of claim 1, wherein the dampener is a unitary member that extends annularly and continuously about an axis of rotation of the shaft.

9. The compressor assembly of claim 1, wherein the bearing is a greasepack ball bearing.

10. An electrically driven compressor assembly comprising:

a shaft;

a compressor wheel that is supported on the shaft;

an electric motor with a stator and a rotor, the electric motor configured to rotate the shaft and the compressor wheel;

a housing assembly that houses the stator, the rotor, and at least part of the shaft, the housing assembly including a first member and a second member, the first member including an open end, the second member at least partly covering the open end, a first inner diameter surface of the first member opposing a second outer diameter surface of the second member, the first member including a first face that faces in a first longitudinal direction relative to an axis of rotation, and the second member including a second face that faces in a second longitudinal direction relative to the axis of rotation;

a bearing that is attached to the second member of the housing assembly and that is attached to the shaft, the bearing supporting the shaft for rotation relative to the second member about the axis of rotation;

a dampener disposed between and abutting the first inner diameter surface of the first member and the second outer diameter surface of the second member of the housing assembly, the dampener configured to elastically deform to provide dampening of a radial force transferred between the first member and the second member of the housing assembly with respect to the axis of rotation;

wherein the dampener abuts the first face of the first member and abuts the second face of the second member; and wherein the dampener is configured to deform to provide dampening of a longitudinal force that is transferred longitudinally between the first member and the second member.

11. The compressor assembly of claim 10, wherein the bearing is a first bearing and the dampener is a first dampener;

wherein the housing assembly further includes a third member, wherein the first member, the second member, and the third member cooperate to encapsulate the rotor and the stator;

further comprising a second bearing that is attached to the third member of the housing assembly and that is attached to the shaft, the bearing supporting the shaft for rotation relative to the third member about the axis; and further comprising a second dampener that is disposed between the first member and the third member, the second dampener configured to elastically deform to provide dampening of a force that is transferred between the first member and the third member of the housing assembly.

12. The compressor assembly of claim 10, wherein the bearing is a greasepack ball bearing.

13. A method of manufacturing an electrically driven compressor assembly comprising:

providing a first member and a second member of a housing assembly, the first member including an open end;

supporting a shaft on the second member for rotation relative to the second member about an axis of rotation with a bearing, the bearing attached to the second member and attached to the shaft;

supporting a compressor wheel on the shaft;

housing an electric motor within the first member and the second member of the housing assembly, the second member at least partly covering the open end of the first member and a first radial surface of the first member opposing a second radial surface of the second member, a first face of the first member facing in a first longitudinal direction relative to the axis of rotation, a second face of the second member facing in a second longitudinal direction relative to the axis of rotation, the electric motor configured to rotate the shaft and the compressor wheel; and attaching the first member and the second member together with a dampener between the first radial surface of the first member and the second radial surface of the second member, including abutting the dampener against the first radial surface of the first member, the second radial surface of the second member, the first face of the first member, and the second face of the second member; and the dampener configured to elastically deform to provide dampening of a radial force transferred between the first member and the second member of the housing assembly with respect to the axis of rotation.

* * * * *